United States Patent [19]

Miller

[11] Patent Number: 4,696,088

[45] Date of Patent: Sep. 29, 1987

[54] METHOD OF CONVERTING A HOPPER TYPE OF RAIL CAR TO ACCEPT A WIDER OUTPUT GATE

[75] Inventor: Roy W. Miller, Highland, Ind.

[73] Assignee: Pullman Rail Leasing Corporation, Chicago, Ill.

[21] Appl. No.: 919,973

[22] Filed: Oct. 17, 1986

[51] Int. Cl.[4] ..... B21K 7/12

[52] U.S. Cl. ..... 29/401.1; 29/418; 29/426.4

[58] Field of Search ..... 29/401.1, 418, 423, 29/426.1, 426.4, 462, 464, 469; 105/247, 248, 416, 417

[56] References Cited

U.S. PATENT DOCUMENTS

| | | | |
|---|---|---|---|
| 2,591,924 | 4/1952 | Dorey | 29/462 |
| 2,669,015 | 2/1954 | Schanz | 29/462 |
| 4,484,528 | 11/1984 | Anderson et al. | 105/248 |

*Primary Examiner*—Mark Rosenbaum
*Assistant Examiner*—Irene Graves Golabi
*Attorney, Agent, or Firm*—Barry L. Clark

[57] ABSTRACT

Method of converting a hopper type of rail car to accept a wider outlet gate permits existing cars which are in over-supply to be made useful. The method requires that the opposed pairs of side slope sheets of the original car, and the opposed pairs of center and end slope sheets which are joined to them to form the bottom portions of the hoppers, be cut apart. One of the pairs of slope sheets then has its width reduced at its lower end portion while the lower end portions of the other pair of slope sheets are cut away and replaced by new slope sheet portions which are of greater width than the original portions. After the mounting flanges for the original outlet gates are removed, new mounting flanges which are wider in one direction and narrower in the other, are located in a predetermined fixed position relative to the frame of the car, preferably by an assembly jig which is temporarily clamped to the car frame. The pair of slope sheets which had its width reduced is then bent outwardly into contact with the mounting flange. The new pair of slope sheet portions is then welded into position relative to the hoppers and the pair of slope sheets whose width was reduced. To relieve stress in the slope sheets which are bent outwardly, the seam about which they are bent relative to the hoppers is heated.

4 Claims, 8 Drawing Figures

FIG. 1
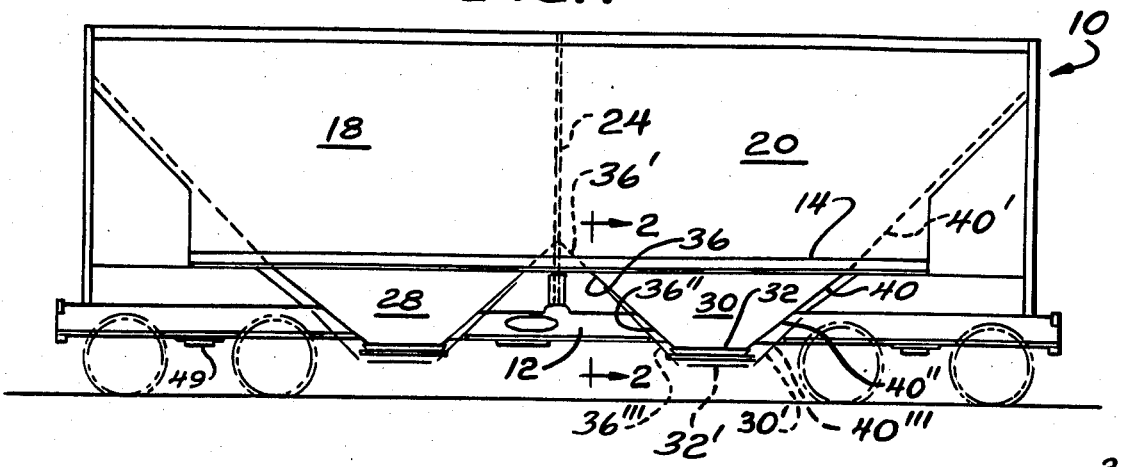
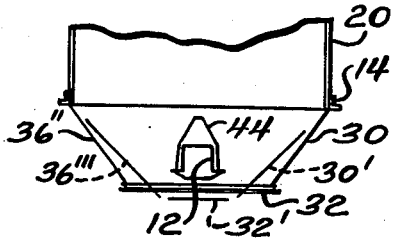
FIG. 2
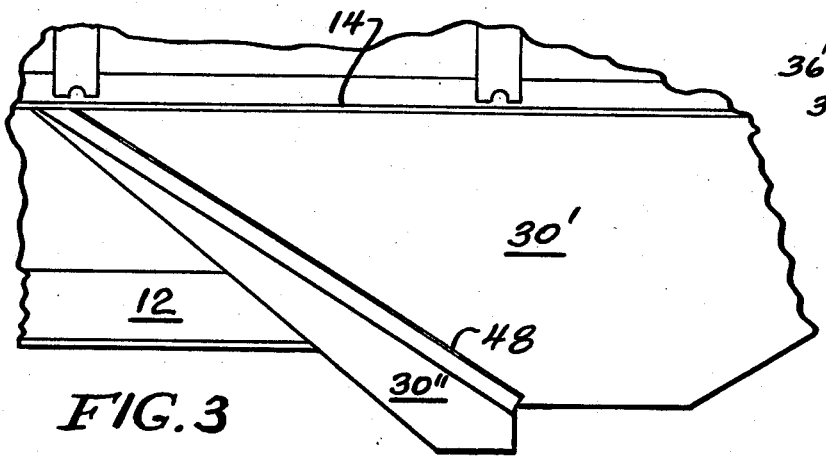
FIG. 3
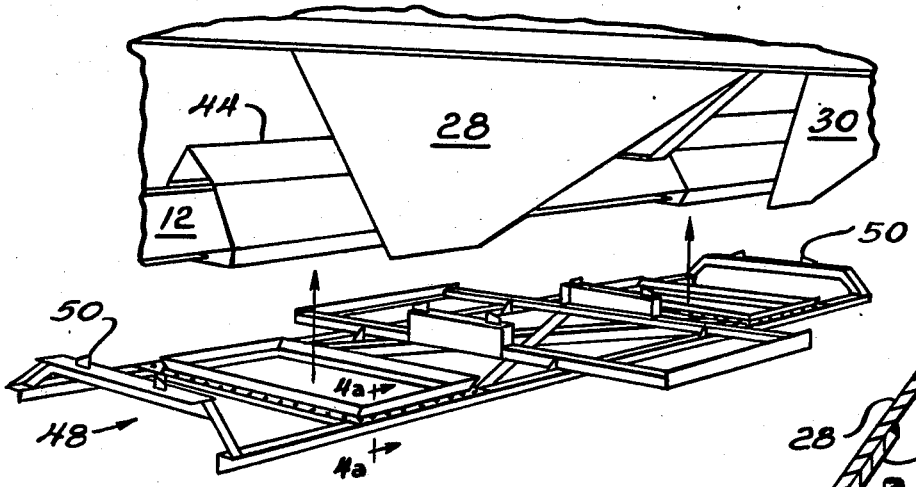
FIG. 4
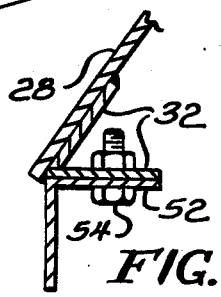
FIG. 4a

METHOD OF CONVERTING A HOPPER TYPE OF RAIL CAR TO ACCEPT A WIDER OUTPUT GATE

BACKGROUND OF THE INVENTION

The invention relates to rail cars and more particularly to covered multiple hopper cars of the type used to handle bulk shipments of particulate materials. As a general rule, a covered hopper car can be made in a wide range of sizes to accommodate different volumes of materials. However, in the interest of safety and to prevent overloading of tracks and bridges, limits are also imposed on the gross loading of a rail car and its contents which is applied to the rails. Limits are also imposed on the overall height of its load in order to keep the car's center of gravity within a prescribed limit.

The density of a particular product to be transported by a rail car can vary widely from low density plastic pellets having a density of about 28 pounds per cubic foot, to grain with a density of about 35 pounds per cubic foot and on to aggregate such as sand, gravel and cement having a density of about 90–100 pounds per cubic foot. To maximize load sizing and the efficiencies of handling, it has been common to build cars for specific commodities so that, in the United States, approximately 100 tons of a particular commodity can be transported in a single car. Thus, for example, one might see four-hopper cars used for handling light products, three-hopper cars used for handling grain, and two-hopper cars used for handling cement, sand and gravel. Alternatively, a car can be manufactured which has smaller or larger hoppers, depending upon whether it is being designed to handle a certain weight of a high density material or a low density material. Since a hopper car can have a useful life of 40–50 years, it can and does happen that the existing stock iof all types of hopper cars might periodically be out of balance with the current needs of a nation's economy.

At the present time, there is a considerable oversupply of three-hopper grain hauling cars and an undersupply of two-hopper cars for hauling aggregate. Rather than scraping some of the three-hopper cars and then building new two-hopper cars, it would seem desirable to convert the three-hopper cars to smaller two-hopper cars which would have to be suitable for carrying aggregate.

A method of converting a three-hopper car into a two-hopper car is disclosed in my co-pending U.S. patent application, Ser. No. 828,415, filed Feb. 11, 1986, the subject matter of which is herein incorporated by reference. In the referenced application, the general configuration of the hoppers and their outlet gates is not disclosed as being changed during the conversion. However, when the three-hopper car being converted is a grain carrying car having conventional 24"×30" outlet gates, the resulting two-hopper car will of course also have 24"×30" outlet gates. Although such gates can be used to unload cement and aggregate, it is usually necessary to place an adapter onto the receiving structure into which the hoppers are to be unloaded since such receiving structures are generally built to accommodate 13"×42" outlet gates. The use of adapters and transition seals are especially important when the commodity being carried in the car is cement since cement not only flows like a liquid but can be extremely troublesome if it leaks out or spills during unloading. However, the use of adapters requires additional labor at the receiving location. To eliminate the need for such additional labor, it would be highly desirable to have a 13"×42" outlet gate permanently installed on a two-hopper car to be used for cement and aggregate service.

Because of the manner in which a hopper car is made, it is not possible to simply substitute a 13"×42" outlet gate for one that is 24"×30". This is so since the side slope sheets and the end and center slope sheets of a hopper having a 24"×30" outlet gate are welded to each other in a special jig or fixture when the hopper car is initially assembled, and the various slope sheets are arranged at particular angles which will direct all of the material in the hopper into the outlet gate. The side slope sheets required for a hopper having a 24"×30" outlet gate are of course much wider than the side slope sheets required for a hopper having a 13"×42" outlet gate. Similarly, the end and center slope sheets required for a hopper having a 24"×30" outlet gate are much more narrow than the corresponding slope sheets required for a 13"×42" outlet gate. In addition, the most common cement unloading equipment in the U.S.A. is designed for use with dual hopper cars having a center line to center line dimension between hoppers of 12.0 feet. This dimension is 6.375" less than the similar dimension on the converted three-hopper to two-hopper car described in the aforementioned co-pending U.S. patent application Ser. No. 828,415.

SUMMARY OF THE INVENTION

It is an object of the present invention to provide a method of converting a hopper type rail car from a first configuration having its slope sheets arranged at a first set of slope angles which will accommodate a first outlet gate of a first rectangular shape, into a second configuration having its slope sheets arranged at a second set of slope angles which will accommodate a second outlet gate having a second rectangular shape.

Another object of the invention is to provide a method of supporting the slope sheets of a hopper being altered so that they can be located as precisely relative to the frame of hopper car as they were when the car was originally assembled.

The foregoing and other objects and advantages are achieved by the method of the present invention in which an existing dual hopper rail car, such as the car disclosed in co-pending U.S. application Ser. No. 828,415, has its hoppers converted so that they may have rectangular outlet gates attached thereto which are of a substantially different size than the outlet gates which were attached to them in their original configuration. Briefly, the conversion operation, as it applies to a 4427 cubic foot grain car which had previously been converted from a three-hopper to a two-hopper configuration, involves taking the trucks off of the rail car and jacking the ends of the car up on its center sill frame member. The existing 24"×30" outlet gates are unwelded from the hopper mounting flanges and removed. The end and center slope sheets are then marked and cut horizontally from one side sill to the other while the portions below the cut are unwelded from the outside slope sheets and from the center sill hood and discarded. The gusset plates which extend from the center bulkhead to the center slope sheets are removed and those which contact the end slope sheets are cut away. At this point, stiffening means such as lengths of angle iron may be temporarily attached to either the outside or inside surface of the side slope sheets to facilitate their being deformed outwardly to their new slope angle by use of a jack means. The outside slope sheets are next marked to their new desired size and cut with a cutting torch. The new, and wider, lower portions of the center and end slope sheets are fabricated and then lifted into the hopper and retained in a temporary position until they can be welded into their final position. A pair of new, rectangular outlet gate mounting flanges, each of which is adapted to have a 13"×42" outlet gate bolted to it, are then fabricated and bolted to a large mounting jig assembly. The mounting jig assembly is then raised and clamped to the center sill of the car. The mounting jig includes a number of alignment projections which are adapted to contact predetermined portions of the center sill. Thus, perfect registration can be achieved between the jig, the outlet gate mounting flanges carried by the jig, and the center sill and other frame portions of the rail car. Since the jig holds the outlet gate mounting flanges in their final positions, the outside slope sheets, which have been cut to their new size, can next be jacked outwardly against the mounting flange and tack welded in position. To relieve the stress placed in the outside slope sheets by the jacking operation, heat is applied along the horizontal line about which the bending of the sheets takes place. The new lower portions of the end and center slope sheets, which were previously placed inside the hoppers, may next be positioned and tack welded to the mounting flange and to the existing upper portions of the end and center slope sheets which did not have to be removed. The finish welding between the side, center and end slope sheets is accomplished next, along with the completion of the welding of the slope sheets to the outlet gate mounting flanges. Next, new gusset plates are positioned and welded between the center slope sheets and the center bulkhead and at the end slope sheets. The mounting bolts which held the outlet gate mounting flanges to the jig are removed and then the jig clamps are removed, permitting the jig assembly to be lowered and removed from the rail car. After the jig is removed, the new outlet gates can be mounted to the mounting flanges, using the same holes which were used to hold the mounting flanges to the jig assembly.

BRIEF DESCRIPTION OF THE DRAWINGS

FIG. 1 is a side elevation of a dual hopper rail car which has had the side slope sheets of its hoppers converted from the relatively wide width shown in phantom lines to the relatively narrow width shown in solid lines;

FIG. 2 is an end elevation sectional view taken on line 2—2 of FIG. 1 and shows a dual hopper car which has had its original relatively narrow end and center slope sheets, which are shown in phantom lines, replaced by wider end and center slope sheets;

FIG. 3 is a fragmentary perspective view of a side slope sheet of a dual hopper car which has been partially converted, and illustrates the use of a guide bar clamped to the side slope sheet to facilitate the cutting away of unwanted portions of the side slope sheet;

FIG. 4 is a fragmentary perspective view showing a hopper which has had its original side slope sheets cut down in width and its center and end slope sheets removed; and an assembly jig which has the mounting flange members for the new hopper outlet gates bolted to it, said assembly jig being positioned beneath its use position wherein it would be temporarily clamped to the center sill of the rail car;

Figure 5:
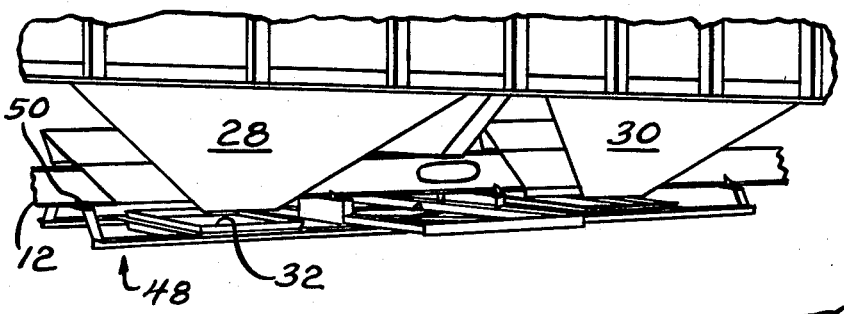
Figure 6:
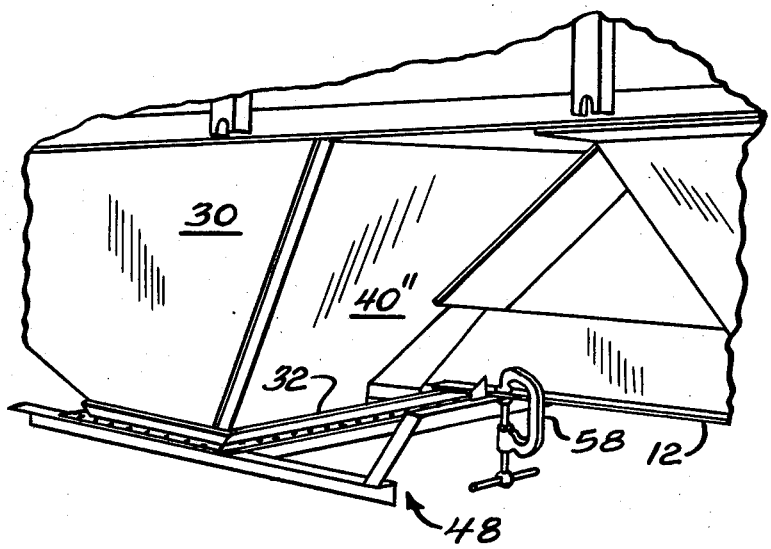
Figure 7:
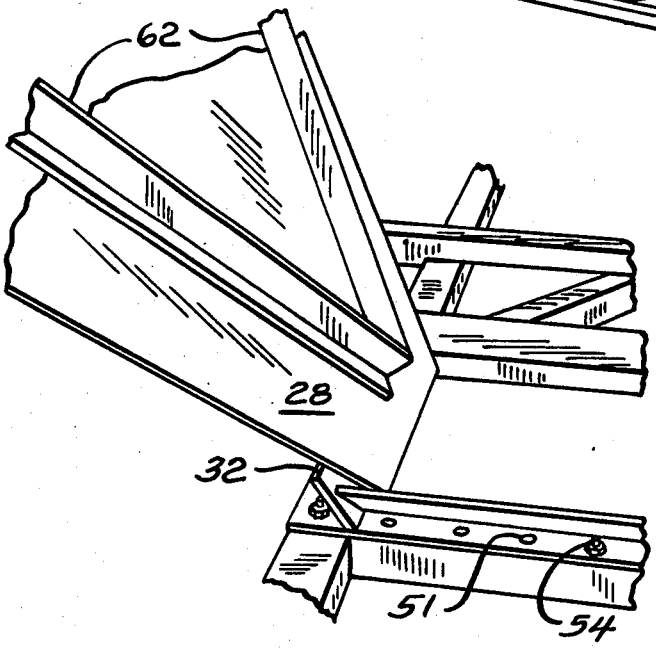

FIG. **4*a* is a sectional view taken on line 4*a*—4*a* of FIG. 4**;

FIG. 5 is a fragmentary perspective view showing the relationship of the assembly jig and side slope sheets of FIG. 4 after the assembly jig has been clamped to the center sill;

FIG. 6 is a fragmentary perspective view showing the relationship of the center and side slope sheets to each other after they have been welded to each other but before the assembly jig is unclamped; and FIG. 7 is a fragmentary perspective view showing the application of temporary reinforcing angles to the side slope sheet to maintain its rigidity so that it can be forced outwardly by jack means into contact with the edges of the outlet gate mounting flange.

DETAILED DESCRIPTION OF THE INVENTION

FIG. 1 shows a converted dual hopper rail car indicated generally at which includes a center sill support frame member 12 and side sills 14. The hoppers 18, 20 are separated from each other by a vertical center bulkhead member 24 and have lower side slope sheets 28, 30 which, in accordance with the method and teachings of the invention, are cut down during conversion from the larger side slope sheets 28', 30' shown in phantom lines. Positioned at the bottom of the hoppers are 13"×42" outlet gate mounting flanges 32 which are much narrower than the pre-conversion 24"×30" mounting flanges indicated in phantom at 32'. The upper portion 36' of the center slope sheet 36, which is the portion located above the side sill 14, is not affected by the conversion operation. However, the lower portion 36" which is present after the conversion is positioned at a small angle relative to the upper portion 36', as compared to being coplanar with it before conversion, as shown by the phantom line at 36'''. In a similar manner the end slope sheet 40 has its lower end portion 40" after conversion at an angle to the upper end portion 40'. It will be noted that the angle between the new and old center slope sheets 36", 36''' is less than the angle between the new and old end slope sheets 40", 40'''. This variance is to permit the distance between the center lines of the outlet gates of the hoppers 18, 20 to be brought closer together than they were before the conversion, in order to conform to a desired spacing required for certain unloading equipment.

FIG. 2 illustrates how the center slope sheet 36", which is added during the conversion, is wider than the original center slope sheet 36''', which is shown in phantom lines. The view also illustrates how the center sill frame member 12 is covered by a hood member 44 which has a generally pointed upper surface to prevent the commodity carried in the hopper from settling on top of the center sill. One can also see that the side slope sheets 30 must be pivoted outwardly relative to the side sills 14 from their pre-conversion location indicated in phantom lines at 30'.

FIG. 3 illustates how the original side slope sheet 30' appears during the conversion operation as it is being cut down. The sheet 30' is shown in its configuration after the right side and bottom portions have been cut away and just before the left side portion 30" is to be cut away. To insure that the cut edges will be straight, a guide bar 48 is clamped to the sheet 30' at the desired angle of the new slope sheet 30. A cutting torch, not shown, is then used to cut away the portion 30".

FIG. 4 is a fragmentary perspective view illustrating the relationship between the jig assembly indicated generally at 48, the side slope sheets 28, 30 and the center sill member 12. While the jig assembly is on the ground, as shown, the new outlet gate mounting flanges 32 are bolted to it so as to positively locate them. The jig assembly has a plurality of vertical projections 50 which are adapted, when the assembly is raised to its FIG. 5 position, to engage the side edges of the center sill 12, thus assuring side to side alignment. The jig assembly is aligned in a fore and aft direction by positioning it at a predetermined distance from the center plate bowls 49, as best seen in FIG. 1.

FIG. 4*a* is an enlarged showing which indicates the manner in which the outlet gate mounting flange member 32 having apertures 51, best seen in FIG. 7, is bolted to the longitudinal frame member 52 of the jig assembly 48 by bolt fasteners 54. For purposes of illustration only, the side slope sheet 28 is shown in the position it would assume after being bent outwardly against the flange member 32, as shown in FIG. 7.

FIG. 5 is a fragmentary perspective view illustrating the mating relationship between the jig assembly 48 and center sill 12, which permits the hoppers, including the side slope sheets 28, 30, to be accurately positioned in their final desired relationship to the new outlet gate mounting flanges 32 which are mounted on the jig assembly.

FIG. 6 is a fragmentary perspective view showing how the jig assembly 48 is firmly fixed to the center sill 12 by a plurality of clamp members 58. Once the jig assembly is clamped, the mounting gate flanges 32 will be in their desired final position relative to the other parts of the rail car so that the side slope sheets 30, 28, for example, can be bent outwardly against the flange 32 and welded to it, as best seen in FIG. 4*a*. Also, the new center slope sheets 40″ can be welded to the side slope sheets 30 and to the flange 32. Once these slope sheets are welded to each other and to the outlet gate mounting flange 32, the bolts 54 can be removed and the jig assembly 48 lowered and moved away from the rail car. The new 13″×42″ outlet gates, not shown, can then be attached to the apertures 51 in the mounting flanges 32 by the bolts 54.

FIG. 7 illustrates how the side slope sheets 28, 30 can be temporarily reinforced by stiffening angles 62 while they are forced outwardly against the flange 32 by a jack means, not shown, which is preferably backed up by the center sill 12. The angles 62 can actually be tack welded to either the inner or outer surface of the slope sheets. As previously explained, the pivoted slope sheets must be pivoted outwardly about their welded connection to the side sills, as best seen in FIG. 2. Since such pivoting would greatly stress the welded joint, it is preferred that the weld joint be heated along its length to relieve the stresses induced by the bending operation.

I claim:

1. A method of converting a hopper type of rail car from a first hopper configuration which includes a hopper having side sills and a center sill and which further includes a first set of outside, end and center slope sheets which are joined to each other and affixed to the body of the hopper at a first set of slope angles, said first set of slope sheets being welded directly to a first mounting flange of a first bottom outlet gate of a first predetermined rectangular size, into a second hopper configuration in which the hopper has outside, end and center slope sheets which are joined to each other and affixed to the body of the hopper at a second, and different set of slope angles, said second set of slope sheets being affixed directly to a second mounting flange of an outlet gate of a second, and different, predetermined rectangular configuration, said method comprising the steps of: removing said first mounting flange; cutting apart the slope sheets of said first set along at least the lines where they are joined to each other in the region thereof located beneath said side sills; cutting away and removing portions of at least the side extremities of a first opposed pair of slope sheets in said first set and cutting away and removing at least that portion of a second opposed pair of slope sheets in said first set which is located in the region beneath said side sills; replacing the removed portion of said second opposed pair of slope sheets in said first set with new slope sheet portions which have a greater width at their lower ends than the removed portions; locating and positively retaining the second mounting flange in its desired final location relative to the side sills and the center sill; applying force to each of the first opposed pair of slope sheets to cause their lower edges to move divergently from each other and into contact with a first pair of opposed side portions of said second mounting flange; attaching said new slope sheet portions to a second pair of opposed side portions of said second mounting flange; applying heat to said first opposed pair of slope sheets in a horizontal line at an upper portion thereof to relieve the stress introduced therein by said step of applying force; and welding all of said slope sheets in said second set to each other and to said second mounting flange.

2. A method according to claim 1 wherein said second mounting flange is located and positively retained relative to the side sills and center sill by first temporarily mounting it to a jig assembly and then temporarily mounting the jig assembly to the center sill at a predetermined location relative thereto.

3. A method according to claim 2 wherein said jig assembly is temporarily mounted to the center sill by clamping it to the center sill.

4. A method according to claim 1 including the step of affixing stiffening members to one surface of said first opposed pair of slope sheets before force is applied to them to cause them to move divergently relative to each other.

* * * * *